US007421783B2

(12) United States Patent
Namburi et al.

(10) Patent No.: US 7,421,783 B2
(45) Date of Patent: Sep. 9, 2008

(54) METHODS OF INSTALLING CENTERLINE SUPPORTED CARRIERS FOR STEAM TURBINES

(75) Inventors: Adinarayana N. Namburi, Naskayuna, NY (US); James D. Schuhl, Charlton, NY (US); William E. Adis, Scotia, NY (US)

(73) Assignee: General Electric Company, Schenectady, NY (US)

( * ) Notice: Subject to any disclaimer, the term of this patent is extended or adjusted under 35 U.S.C. 154(b) by 589 days.

(21) Appl. No.: 10/986,434

(22) Filed: Nov. 12, 2004

(65) Prior Publication Data

US 2006/0101643 A1 May 18, 2006

(51) Int. Cl.
*B21K 25/00* (2006.01)

(52) U.S. Cl. ..... 29/889.2; 29/525.01; 29/525.02; 29/525.11

(58) Field of Classification Search ..... 29/889.2, 29/525.01, 525.02, 525.11
See application file for complete search history.

(56) References Cited

U.S. PATENT DOCUMENTS

| | | | | |
|---|---|---|---|---|
| 1,485,887 | A * | 3/1924 | Scanlan | 454/338 |
| 4,590,653 | A * | 5/1986 | Ades et al. | 29/889.2 |
| 5,004,017 | A * | 4/1991 | White | 138/106 |
| 5,170,551 | A * | 12/1992 | Norberg | 29/523 |
| 6,352,404 | B1 * | 3/2002 | Czachor et al. | 415/116 |

* cited by examiner

*Primary Examiner*—Rick K Chang
(74) *Attorney, Agent, or Firm*—Nixon & Vanderhye, PC

(57) ABSTRACT

Jack screws are threaded into the lower carrier half adjacent opposite ends and sides of the lower carrier half for supporting it on temporary support plates on shoulders in the lower outer shell. Tapped openings are provided below the temporary support plates. Alignment of the steam faces is carried out by adjusting the end jack screws. The upper carrier half is lowered onto the lower carrier half with bores in the upper carrier half receiving upper end portions of the jack screws. Permanent keys are secured to flanges of the upper carrier half to support the carrier from the lower outer shell. The jack screws and temporary plates are removed and hold down bolts are inserted into the bores and thread into the tapped opening to hold the carrier down on the lower outer shell.

6 Claims, 5 Drawing Sheets

METHODS OF INSTALLING CENTERLINE SUPPORTED CARRIERS FOR STEAM TURBINES

The present invention relates to turbines and particularly relates to methods of installing centerline supported upper and lower carrier halves in a lower outer shell half of a turbine to facilitate assembly and alignment of the carrier and outer shell.

BACKGROUND OF THE INVENTION

In turbines, particularly steam turbines, the assembly of the lower carrier half into the lower outer shell half, the rotor into the lower carrier half and the bolting of the upper carrier half and the lower carrier half to one another requires precision alignment and installation of the various elements. Prior assembly procedures required temporary supports, e.g. shims, for the lower carrier half and jacking into alignment until the upper carrier half is in place and horizontal joint bolts are tightened. Assembled carrier jacking also required insertion of guide pins to guide the upper half during assembly onto the lower half to avoid contact with and possible damage to the rotor. The separate elements for jacking and guiding all require areas on the horizontal joints of the carriers where space is limited. Accordingly, there is a need for a method of installing upper and lower carrier halves in a lower outer shell of a turbine which will readily facilitate the guided assembly of the carrier into an accurately aligned position vis a vis the rotor and outer shell.

BRIEF DESCRIPTION OF THE INVENTION

In a preferred embodiment of the present invention there is provided a method of installing a carrier including upper and lower carrier halves in a lower outer shell half of a turbine, comprising the steps of: (a) providing the lower carrier half with female threaded openings adjacent opposite ends and sides of the lower carrier half; (b) threading jack screws into the female threaded openings and disposing the lower carrier half in the lower outer shell half with the jack screws supporting the lower carrier half in the lower outer shell half; (c) locating a turbine rotor in the lower carrier half; (d) lowering the upper carrier half onto the lower carrier half with portions of the jack screws being received in bores in the upper carrier half; (e) securing the upper and lower carrier halves to one another along their horizontal midlines; (f) installing permanent keys between flanges on the upper carrier half and supports on the lower outer shell half, enabling the carrier for support from the lower outer shell half; (g) removing the jack screws; and (h) securing the carrier and the lower outer shell to one another.

In a further preferred embodiment hereof, there is provided a method of installing a carrier including upper and lower carrier halves in a lower outer shell half of a turbine comprising the steps of: (a) providing the lower carrier half with female threaded openings adjacent opposite ends and sides of the lower carrier half; (b) threading jack screws into the female threaded openings and disposing the lower carrier half in the lower outer shell half with the jack screws supporting the lower carrier half in the lower outer shell half; (c) locating a turbine rotor in the lower carrier half; (d) guiding the upper carrier half onto the lower carrier half with portions of the jack screws being received in bores in the upper carrier half and using a close fitting dimensional relationship between the jack screws and bore to guide the upper carrier half onto the lower carrier half; (e) securing the upper and lower carrier halves to one another along their horizontal midlines to form said carrier; (f) installing permanent keys between flanges on the upper carrier half and supports on the lower outer shell half, enabling the carrier for support from the lower outer shell half; (g) removing the jack screws; and (h) securing the carrier and the lower outer shell to one another.

DETAILED DESCRIPTION OF THE INVENTION

Figure 1:
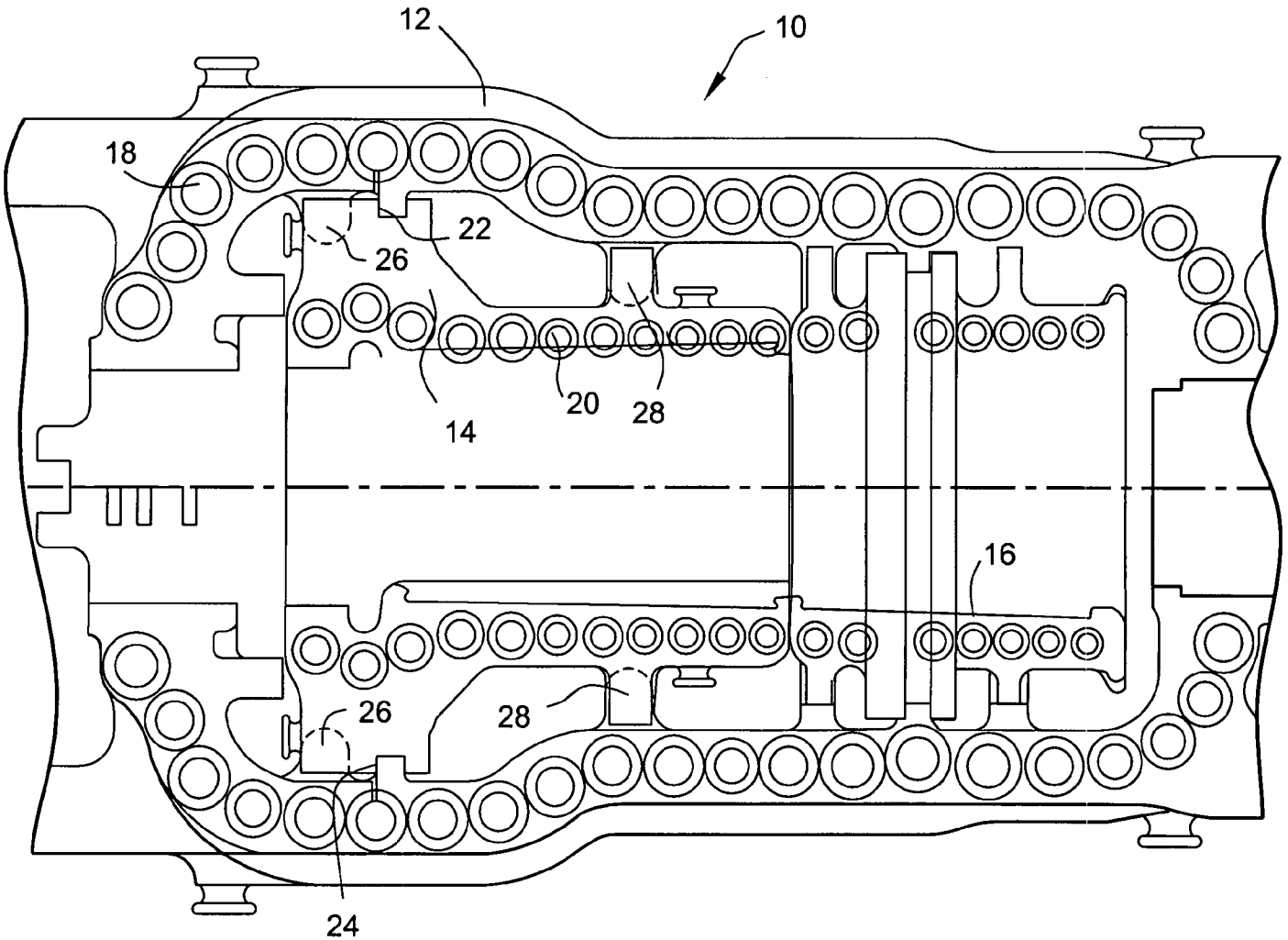
FIG. 1 is a plan view of a turbine open along the horizontal midline illustrating the lower outer shell and the inlet and exhaust lower carrier halves in relation to the outer shell.

Referring now to FIG. 1, there is illustrated a lower half of a turbine, generally designated 10, separated at a horizontal midline. The lower half of turbine 10 includes a lower outer shell 12, a lower inlet carrier half 14 and a lower exhaust carrier half 16. Also illustrated are a series of bolt holes 18 whereby the upper outer shell half 19 (FIG. 5) may be permanently secured to the lower outer shell half 12. Additionally, bolt holes 20 are illustrated for the lower carrier halves whereby the upper inlet and exhaust carrier halves may be secured to the lower inlet and exhaust carrier halves 14 and 16 respectively by bolted connections. The inlet and exhaust carriers, each comprised of upper and lower carrier halves, are secured to the lower outer shell 12 in a similar manner. Thus, the following description of the method of installation of the inlet carrier generally designated 15 will suffice as a sufficient description of the installation of the exhaust carrier.

From FIG. 1, it will be appreciated that the inlet carrier 14 has an axial steam face 22 aligned with an oppositely axially facing steam face 24 on the outer shell 12. In final assembly, these steam faces are aligned parallel to one another. Also illustrated in FIG. 1 are inlet carrier support locations adjacent opposite ends and sides of the inlet carrier 14. Two of these locations 26 are located at the upstream end of the inlet carrier 14 while the remaining two locations 28 are located adjacent the downstream end of the inlet carrier 14. The upstream locations 26 lie on opposite diametrical sides of the turbine axis as do the downstream locations 28. Each of the locations 26 and 28 are identical to one another for purposes of installing the carrier 15 within the lower outer shell 12 and a description of one location suffices for a description of the other locations.

Figure 3:
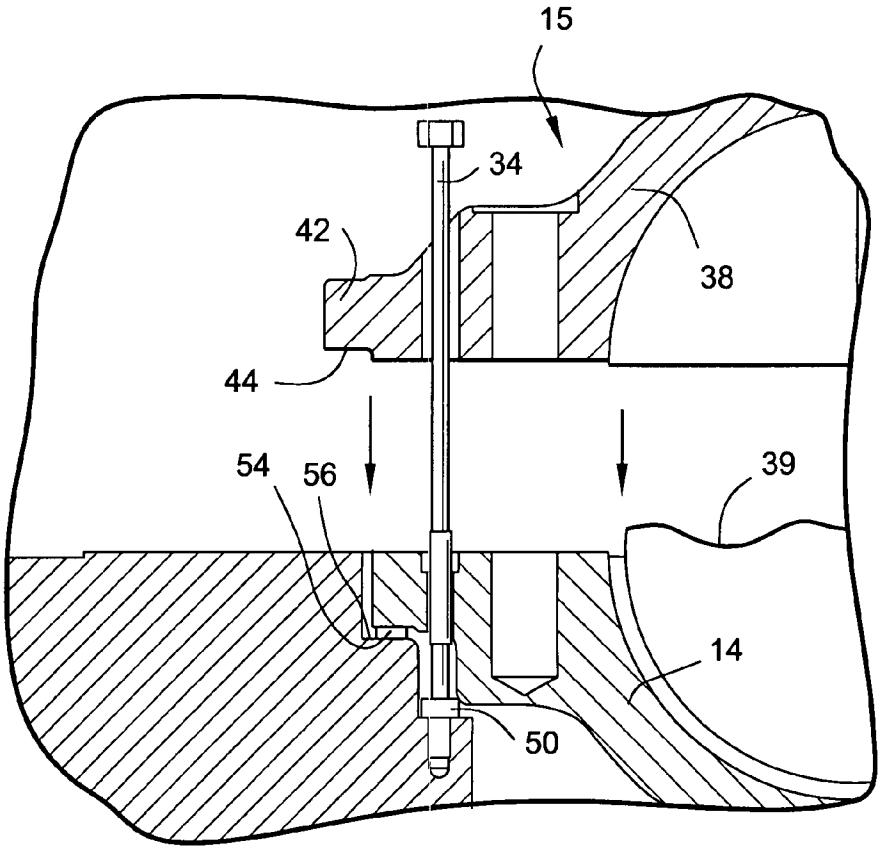
FIG. 3 is an end elevational view illustrating the assembly of the upper and lower carrier halves to one another on the lower outer shell.
Figure 2:
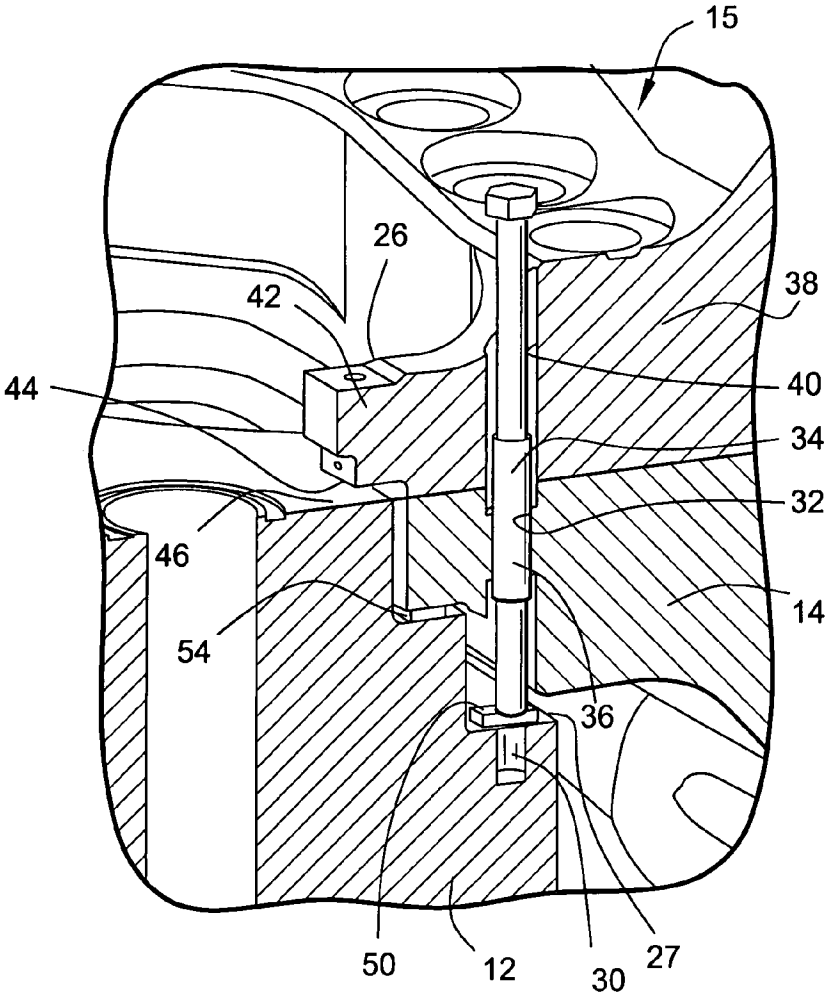
FIG. 2 is a perspective view of assembled upper and lower carrier halves located in the lower outer shell and supported by a jack screw prior to final assembly.

Referring to FIG. 2, and for example inwardly of a directly adjacent location 26, the lower outer shell 12 includes a shoulder 27 having a tapped opening 30. The lower carrier half 14 includes a threaded bore 32 which receives a jack screw 34, the jack screw being threaded in the region 36 for threaded engagement with the threaded bore 32. The upper carrier half 38 includes an enlarged diameter bore 40 through which the upper end portion of the jack screw 34 may be received upon lowering the upper carrier half 38 onto the lower carrier half 14 as described below. Also illustrated in FIG. 2 is a radially outwardly projecting flange 42 carried by the upper carrier half 38. The lower surface 44 of flange 42 as well as a shoulder 46 on the lower outer shell 12 form a clearance for receiving a permanent key 48 (FIG. 3). As will become clear, the key 48 supports the carrier 15 from the lower outer shell 12. Also illustrated in FIGS. 2 and 3 is a temporary support plate 50 overlying the tapped opening 30. As illustrated, the lower ends of the jack screws 34, as part of the installation process, engage the temporary support plates 50 as described below.

Figure 4:
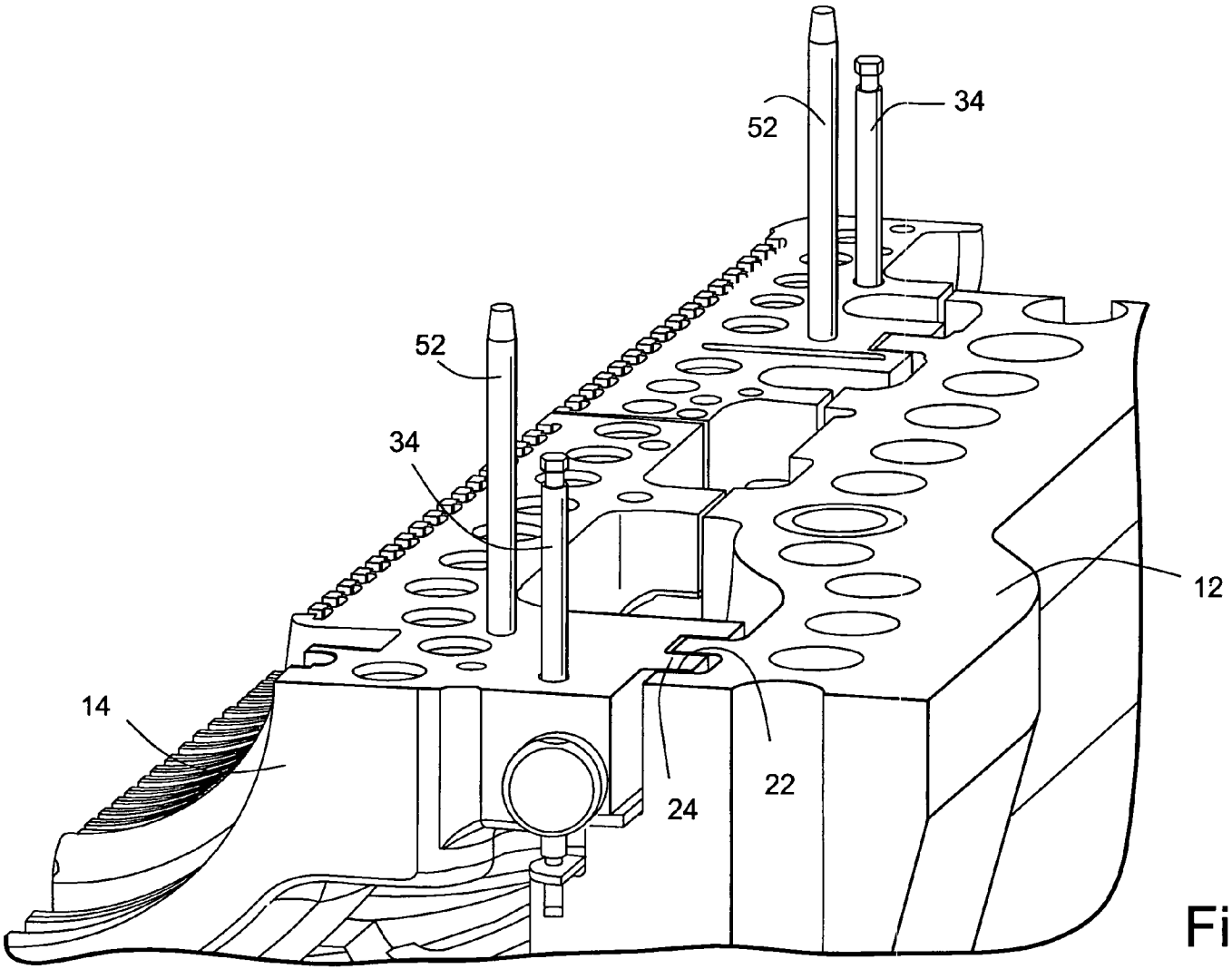
FIG. 4 is a fragmentary perspective view illustrating the horizontal midline of the lower outer shell and lower carrier half during assembly.

Referring to FIG. 4, a portion of the horizontal midline of the lower outer shell 12 and lower carrier half 14 is illustrated. The axial steam faces of the lower outer shell 12 and lower carrier half 14 together with portions of the jack screws 34 are also illustrated. Further, dowels 52 are provided at the horizontal midline along the lower carrier half 14. The dowels 52 project upwardly to guide and align the upper carrier half 38 when the latter is disposed on the lower carrier half 14

Figure 6:
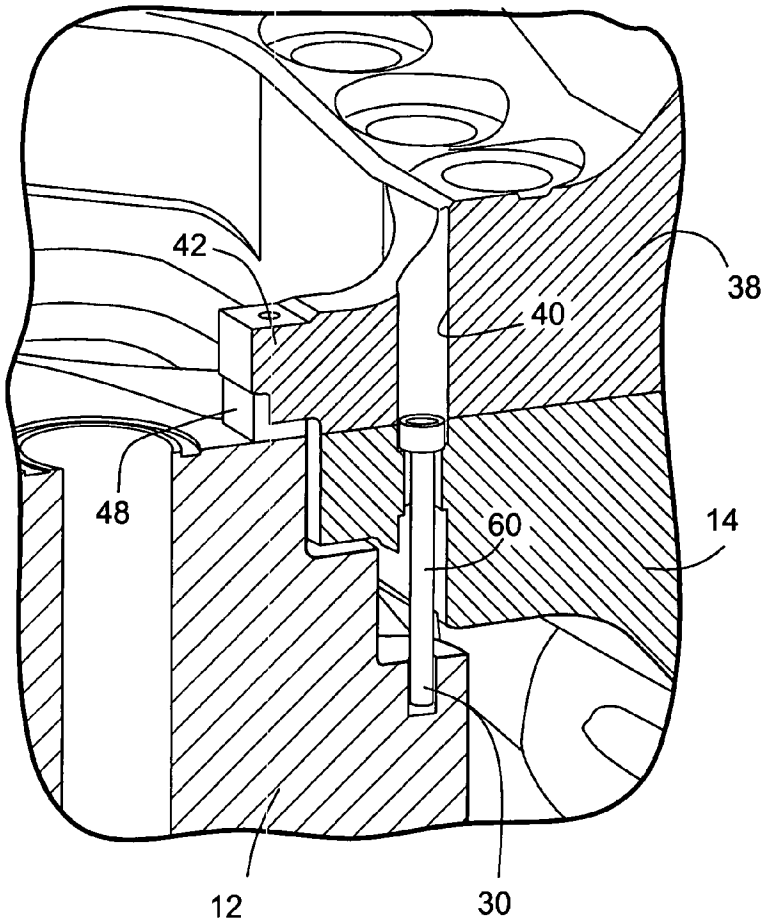
FIG. 6 is a view similar to FIG. 2 illustrating a hold down bolt between the lower carrier half and lower outer shell half.

FIG. 6 illustrates a hold down bolt 60 for holding down the assembled upper and lower carrier halves, i.e. carrier 15 onto the lower outer shell 12. It will be appreciated particularly from the description of the method of installation which follows that each hold down bolt 60 is disposed through the bores 32 and 40 of the lower and upper carrier halves 14 and 38 respectively, and threads into the tapped opening 30 of the outer shell to hold down the assembled upper and lower carrier halves, i.e. carrier 15 to the lower outer shell.

Having described certain aspects of the invention, the installation procedure will now be described. The jack screws 34 are threaded into the bores 34 of the lower carrier half 14 at each of the four locations. Additionally, the temporary support plates 50 are disposed over the tapped openings 30 at each of the four temporary support locations in the outer shell. With the turbine open at the horizontal midline of the lower outer shell, the lower carrier half 14 together with the jack screws 34 are lowered into the lower outer shell 12, e.g. by a crane, not shown, until the lower ends of the jack screws 34 engage the temporary support plates 50 to support the lower carrier half 14 from the lower outer shell 12. A temporary safety key 54 (FIGS. 2 and 3) may be provided between a shoulder 56 on the lower outer shell 12 and a support shoulder on the lower carrier half 14.

Once the lower carrier half is supported by the jack screws 34 on the support plates 50 in the lower outer shell 12, the axial steam faces 22, 24 are aligned parallel to one another. This can be accomplished by threading or unthreading the jack screws at one end of the lower carrier half to cant the lower carrier half about a transverse axis to obtain a parallel relation between the steam faces. The lower carrier half is also aligned in a radial direction relative to datums, not shown. By threading or unthreading the jack screws simultaneously, the lower carrier half can be elevated or lowered relative to the outer shell to achieve vertical radial alignment for various purposes including to align the horizontal midlines of the lower carrier half and lower outer shell half to one another while maintaining the axial steam faces parallel to one another. Lateral radial alignment is achieved by mechanically or electronically aligning the lower corner half to the turbine bearing which is also aligned to the turbine outer shell.

Figure 5:
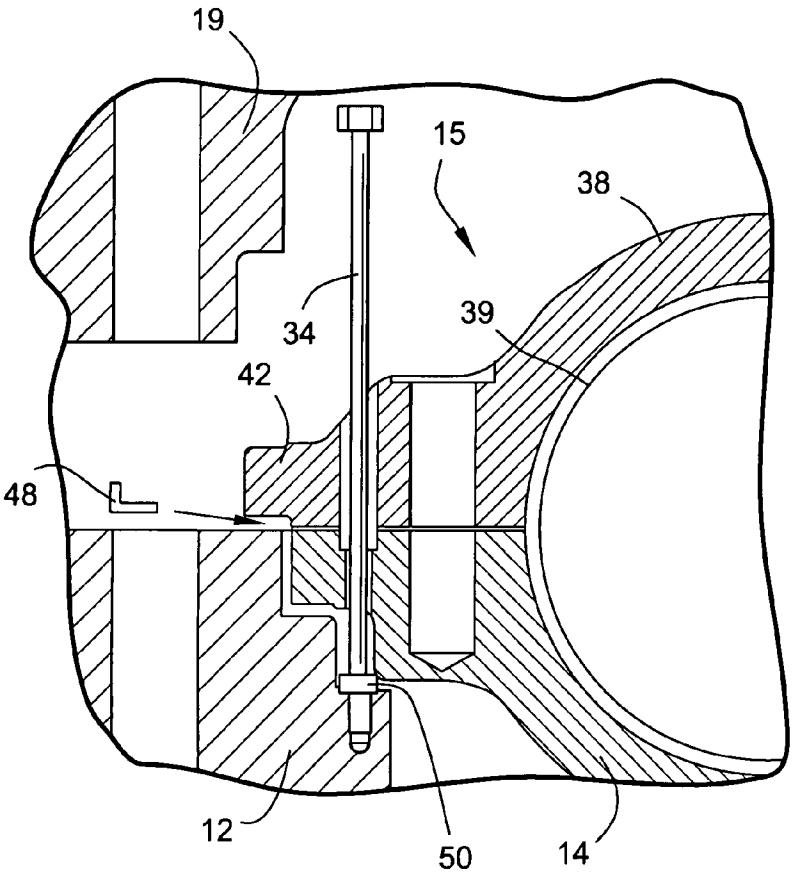
FIG. 5 is a view similar to FIG. 3 illustrating the jacking of the upper and lower carrier halves relative to the outer shell.

The rotor 39 (FIGS. 3 and 5) is then installed in the lower carrier half 14. The upper carrier half 38 is then lowered onto the lower carrier half 14 using the dowels 52 passing through suitable bores in the upper corner half 38 as guides to avoid interference with the rotor. It will be appreciated that when lowering the upper carrier half 38 onto the lower carrier half 14, the bores 40 receive upper end portions of the jack screws 34. When the carrier halves abut one another at the midline, it will be appreciated that the heads of the jack screws project from the bores 40 thereby affording access to tools for threading or unthreading the jack screws. The upper carrier half 38 is then bolted to the lower carrier half 14. By turning the jack screws 34 simultaneously, the carrier 15 including the joined upper and lower carrier halves can be elevated relative to the lower outer shell 12 to provide clearances between the flanges 42 and supports 46 enabling insertion of permanent support keys 58 (FIGS. 5 and 6). The permanent keys 58 are generally L-shaped in configuration and are preferably bolted to the flanges 42. The carrier 15 is then lowered by simultaneously turning the jack screws 34 such that the carrier 15 is supported from the lower outer shell on the permanent keys 58. Various alignment checks may be performed and the carrier assembly manipulated to insure accuracy of its alignment relative to the rotor and outer shell. Once the alignment checks are completed, the jack screws 34 and temporary support plates 50 are removed as well as any safety support plates 54, whereby the carrier 15 is wholly supported by the lower outer shell.

To preclude the carrier 15 from being displaced upwardly relative to the lower outer shell 12, hold down bolts 60 (FIG. 6) are inserted through the bores 40 through which the jack screws 34 have been previously removed. The hold down bolts 60 thread into the tapped openings 30 to secure the carrier 15 to the lower outer shell 12. The upper outer shell 19 (FIG. 5) is then secured by bolting to the lower outer shell 12.

Figure 7:
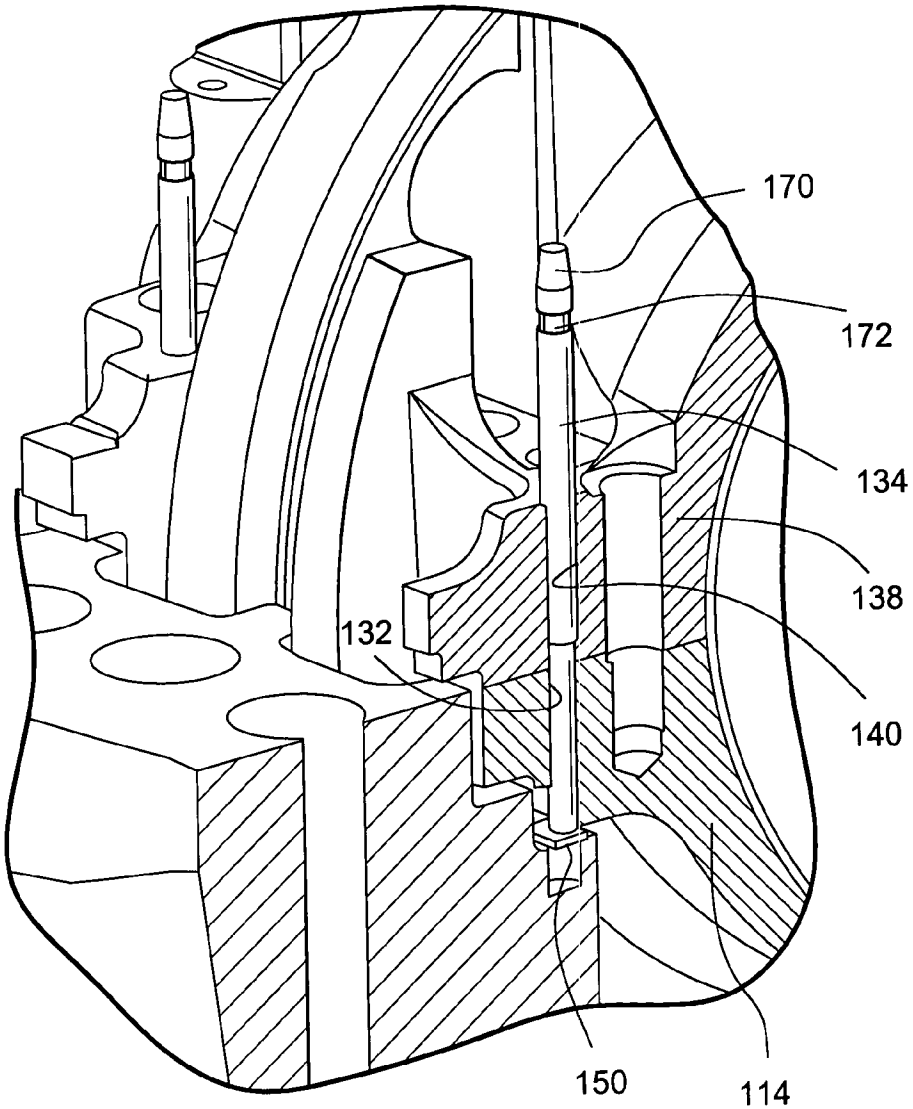
FIG. 7 is a perspective view of a further embodiment illustrating a combined jack screw and guide for the installation.

Referring now to FIG. 7, wherein like reference numerals are applied to like parts preceded by the numeral 1, the jack screws 134 serve as combined jacking screws and guides. Particularly, the jack screws 134 in this aspect of the present invention are threaded into the bore 132 of the lower shell carrier half 114. The outer or upper end of each jack screw 134 is tapered to provide a lead-in 170. Below the lead-in 170, the back screw has reduced diameter multifaceted sides 172 for receiving a tool whereby the jack screw 134 can be rotated in either direction. The bore 140 through the upper carrier half 138 is sized and closely dimensioned to the outer diameter of the jack screw 134. In this manner, when the upper carrier half 138 is lowered onto the lower carrier half 114, the bore 140 serves as a guide for guiding the upper carrier half onto the lower carrier half. Thus the need for separate dowels and holes for receiving the dowels between the carrier halves is entirely eliminated. As in the prior embodiment, the lower ends of the jack screws 134 rest on support plates 150. The steps for installing the carrier enclosing the turbine as previously described with respect to FIGS. 1 and 6 are the same with respect to the embodiment hereof of FIG. 7 except that the dowels are not needed and the jack screws 134 serve as guides to align the upper and lower carrier halves.

Also, hold-down bolts can be used in this embodiment at locations apart from the bores which receive the jack screws. Therefore it will be appreciated, in this instance, that the temporary plates 150 and tapped openings below the plates 150 are not necessary. Further, the hold down bolts at locations apart from the bores at the jack screw guides may in final installation have a space between the hold down bolt heads and the shoulder on the lower carrier half. This enables the lower carrier half to be secured to the lower outer shell half while permitting the lower carrier half to be slightly elevated by threading the jack screws enabling the keys 48 for insertion. With the keys in place, the carrier can be lowered and the jack screws removed. Crush pins, not shown, between the upper carrier half and the upper outer shell are used to assist holding down the carrier onto the lower outer shell.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of installing a carrier including upper and lower carrier halves in a lower outer shell half of a turbine comprising the steps of:

(a) providing the lower carrier half with female threaded openings adjacent opposite ends and sides of the lower carrier half;

(b) threading jack screws into the female threaded openings and disposing the lower carrier half in the lower outer shell half with the jack screws supporting the lower carrier half in the lower outer shell half;

(c) locating a turbine rotor in the lower carrier half;

(d) guiding the upper carrier half onto the lower carrier half with portions of the jack screws being received in bores in the upper carrier half and using a close fitting dimensional relationship between the jack screws and bore to guide the upper carrier half onto the lower carrier half;

(e) securing the upper and lower carrier halves to one another along their horizontal midlines to form said carrier;

(f) installing permanent keys between flanges on the upper carrier half and supports on the lower outer shell half, enabling the carrier for support from the lower outer shell half;

(g) removing the jack screws; and (h) securing the carrier and the lower outer shell to one another.

2. A method according to claim 1 including performing steps (a)-(h) in sequence.

3. A method according to claim 1 including installing a temporary safety key between said lower carrier half and said lower outer shell.

4. A method according to claim 1 including performing steps (a)-(h) in sequence, and, before step (c), adjusting at least a pair of the jack screws at one end of the carrier to obtain a parallel relation between axial faces of said lower outer shell half and said lower carrier half.

5. A method according to claim 1 including inserting a temporary plate supported by the lower carrier half between each of the female threaded openings and the tapped openings; and wherein step (b) includes disposing the lower carrier half in the lower outer shell half with ends of the jack screws engaging the temporary plates.

6. A method according to claim 5 including, prior to step (h) removing the temporary plates from between the jack screw ends and the lower carrier half.

* * * * *